US007410382B2

(12) United States Patent
Wu

(10) Patent No.: US 7,410,382 B2
(45) Date of Patent: Aug. 12, 2008

(54) CABLE CONNECTOR ASSEMBLY WITH ESPECIALLY ARRANGED CABLE OUTLET

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/899,186

(22) Filed: Sep. 4, 2007

(65) Prior Publication Data

US 2008/0003863 A1 Jan. 3, 2008

Related U.S. Application Data

(63) Continuation-in-part of application No. 11/480,039, filed on Jun. 29, 2006, now Pat. No. 7,264,496, which is a continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/358

(58) Field of Classification Search ..... 439/358, 439/351, 352, 353, 354, 355, 356, 357, 555, 439/557, 575

See application file for complete search history.

(56) References Cited

U.S. PATENT DOCUMENTS 5,213,533 A 5/1993 Walden
5,727,963 A 3/1998 Lemaster
5,775,931 A 7/1998 Jones
5,860,826 A 1/1999 Chang
5,941,726 A 8/1999 Koegel et al.
6,099,339 A 8/2000 Yanagida et al.
6,210,202 B1 4/2001 Kuo
6,558,183 B1 5/2003 Ji et al.
6,565,383 B1 5/2003 Wu
6,585,536 B1 7/2003 Wu
6,585,537 B1 7/2003 Lee
6,746,255 B1 * 6/2004 Lee et al. ..... 439/108
6,786,755 B2 9/2004 Dambach et al.
6,808,410 B1 * 10/2004 Lee ..... 439/484
6,846,188 B2 * 1/2005 Hsin et al. ..... 439/79
6,991,487 B2 1/2006 Wu
7,192,297 B1 * 3/2007 Wu ..... 439/358
7,252,531 B2 * 8/2007 Wu ..... 439/358

* cited by examiner

*Primary Examiner*—Chandrika Prasad
(74) *Attorney, Agent, or Firm*—Wei Te Chung

(57) ABSTRACT

A cable connector assembly (1') including an insulative housing (10') defining a forwardly extending mating port with a pair of opposite side portions, with at least one first retention cavity defined therein; a plurality of contacts (20') disposed in the housing; a cover (5) being partially configured to be of an L-shape, said cover including a front and a rear covers (5*a*, 5*b*) assembled to the housing along the front-to-back direction and defining a pair of opposite side sections, with at least one downwardly extending second retention cavity defined therein; wherein the first retention cavity aligned with the corresponding second retention cavity in an up-to-down direction perpendicular to the front-to-back direction; at least one locking member (60') being configured to be of an L-shape and arranged aside corresponding L-shaped section of the cover, said locking member comprising a cover retention section received in the second retention cavity of the cover, and a housing retention section extending into the first retention cavity of the housing; and at least one cable (40') connected to a rear portion of the housing and being partially enclosed by the cover.

11 Claims, 20 Drawing Sheets

CABLE CONNECTOR ASSEMBLY WITH ESPECIALLY ARRANGED CABLE OUTLET

CROSS-REFERENCE TO RELATED APPLICATION

This is a continuation-in-part (CIP) of U.S. patent application Ser. No. 11/480,039, filed on Jun. 29, 2006 and entitled "CABLE CONNECTOR ASSEMBLY HAVING LOCKING MEMBER", now U.S. Pat. No. 7,264,496, which have the same applicant and assignee as the present invention, and which is a continuation-in-part (CIP) of U.S. patent application Ser. No. 10/787,661 filed on Feb. 25, 2004 and entitled "CABLE END CONNECTOR ASSEMBLY HAVING LOCKING MEMBER", now U.S. Pat. No. 6,991,487.

BACKGROUND OF THE INVENTION

1. Field of the Invention

The present invention relates to a cable connector assembly, and more particularly to a cable connector assembly having a cover for adjusting a cable outlet.

2. Description of Related Art

There exists in the art a cable connector assembly known as a Serial Advanced Technology Attachment (Serial ATA) connector which is generally used for disk drives and storage peripherals. Especially, the Serial ATA connectors according to the Serial ATA standard are featured in fewer counts of electrical contacts than other conventional electrical connectors and are relatively tiny in configuration. With the development of the Serial ATA standard, the next-generation serial storage interface effort expands the base Serial ATA 1.0 capabilities to address additional markets segments, including the server and networked storage markets. A cable connector assembly based on Serial ATA II standard is designed to connect with more devices and cables.

U.S. patent application Ser. No. 10/787,661 discloses a kind of horizontal type cable connector assembly which has an insulated housing with a forward mating portion and a number of cables coupled to the rear section of the insulated housing and rearward extending therefrom. Thus, a cable outlet orientation and a mating direction are disposed in opposite directions.

Obviously, other type of cable connector assembly with a different configuration of a cable outlet orientation and a mating direction is desirable.

SUMMARY OF THE INVENTION

Accordingly, an object of the present invention is to provide an cable connector assembly being configured that a cable outlet orientation can be adjusted.

In order to achieve the object set forth, a cable assembly in accordance with the present invention comprising an insulative housing defining a forwardly extending mating port with a pair of opposite side portions, with at least one first retention cavity defined therein; a plurality of contacts disposed in the housing; a cover being partially configured to be of an L-shape, said cover including a front and a rear covers assembled to the housing along the front-to-back direction and defining a pair of opposite side sections, with at least one downwardly extending second retention cavity defined therein, wherein the first retention cavity aligned with the corresponding second retention cavity in an up-to-down direction perpendicular to the front-to-back direction; at least one locking member being configured to be of an L-shape and arranged aside corresponding L-shaped section of the cover, said locking member comprising a cover retention section received in the second retention cavity of the cover, and a housing retention section extending into the first retention cavity of the housing; and at least one cable connected to a rear portion of the housing and being partially enclosed by the cover.

Other objects, advantages and novel features of the invention will become more apparent from the following detailed description when taken in conjunction with the accompanying drawings.

DETAILED DESCRIPTION OF THE INVENTION

Figure 1:
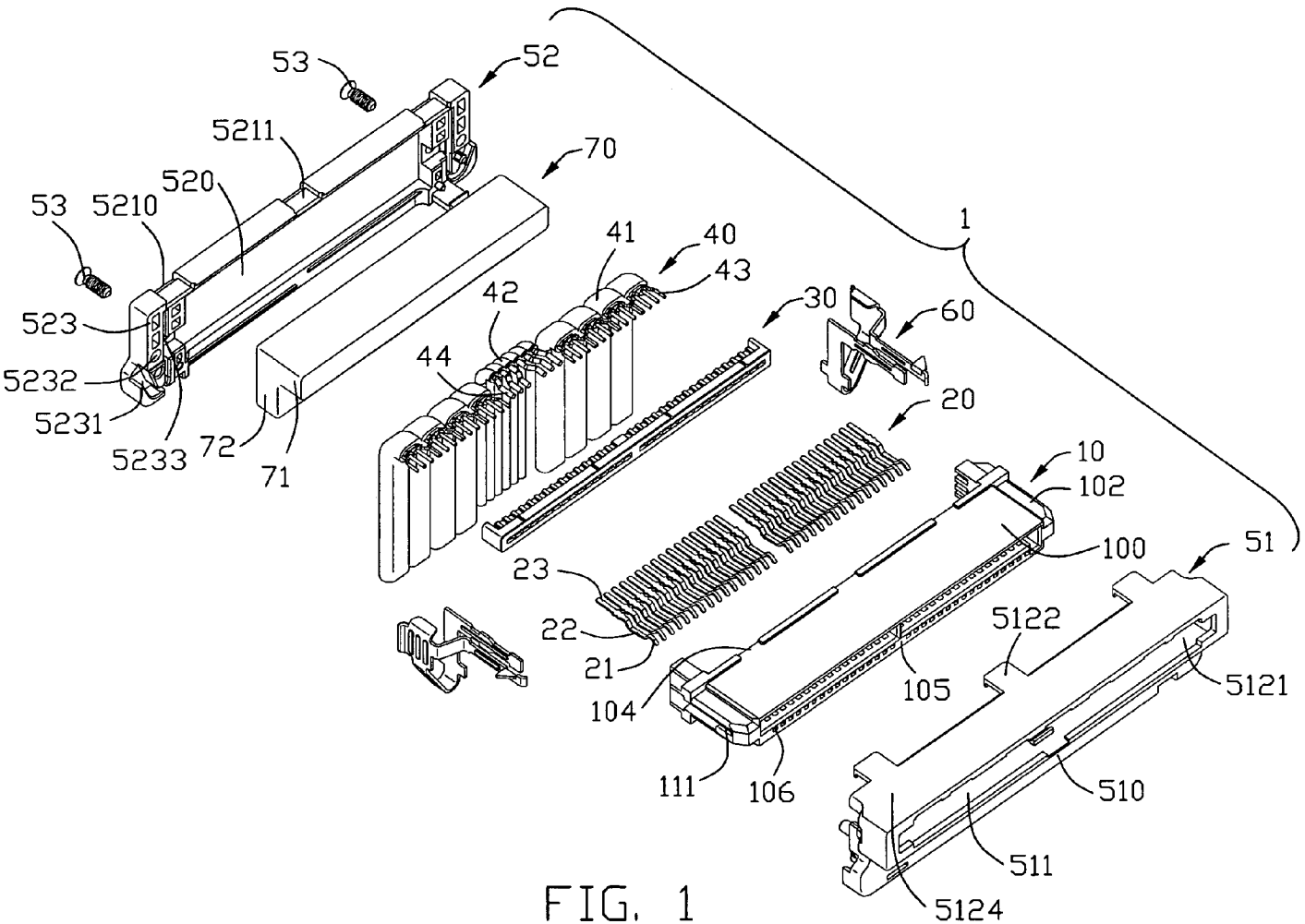
FIG. 1 is an exploded, perspective view of a cable connector assembly in accordance with the first embodiment of the present invention.

Reference will now be made in detail to the preferred embodiments of the present invention.

Referring to FIGS. 1 to 4, a cable connector assembly 1 mating with a complementary connector along a front-to-back direction in accordance with a first embodiment of the present invention comprises an insulative housing 10, a plurality of contacts 20, a spacer 30, a plurality of cables 40, a cover 50 and a pair of locking members 60. In the present invention, the cable connector assembly 1 is in accordance with a Serial ATA II standard. However, in alternative embodiments, the cable connector assembly could be provided as other types.

Figure 2:
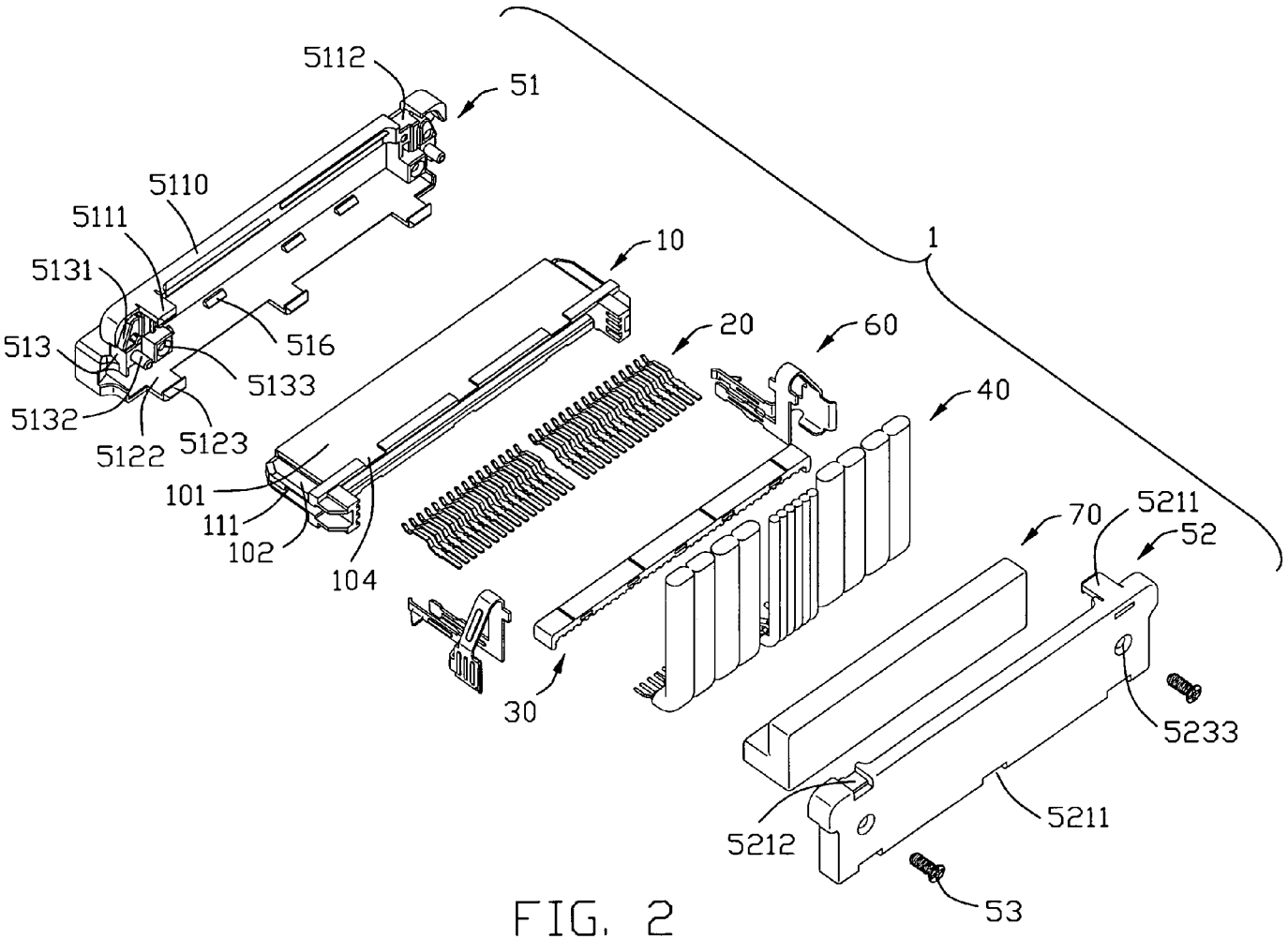
FIG. 2 is an exploded, perspective view similar to FIG. 1, but taken from a different aspect.
Figure 3:
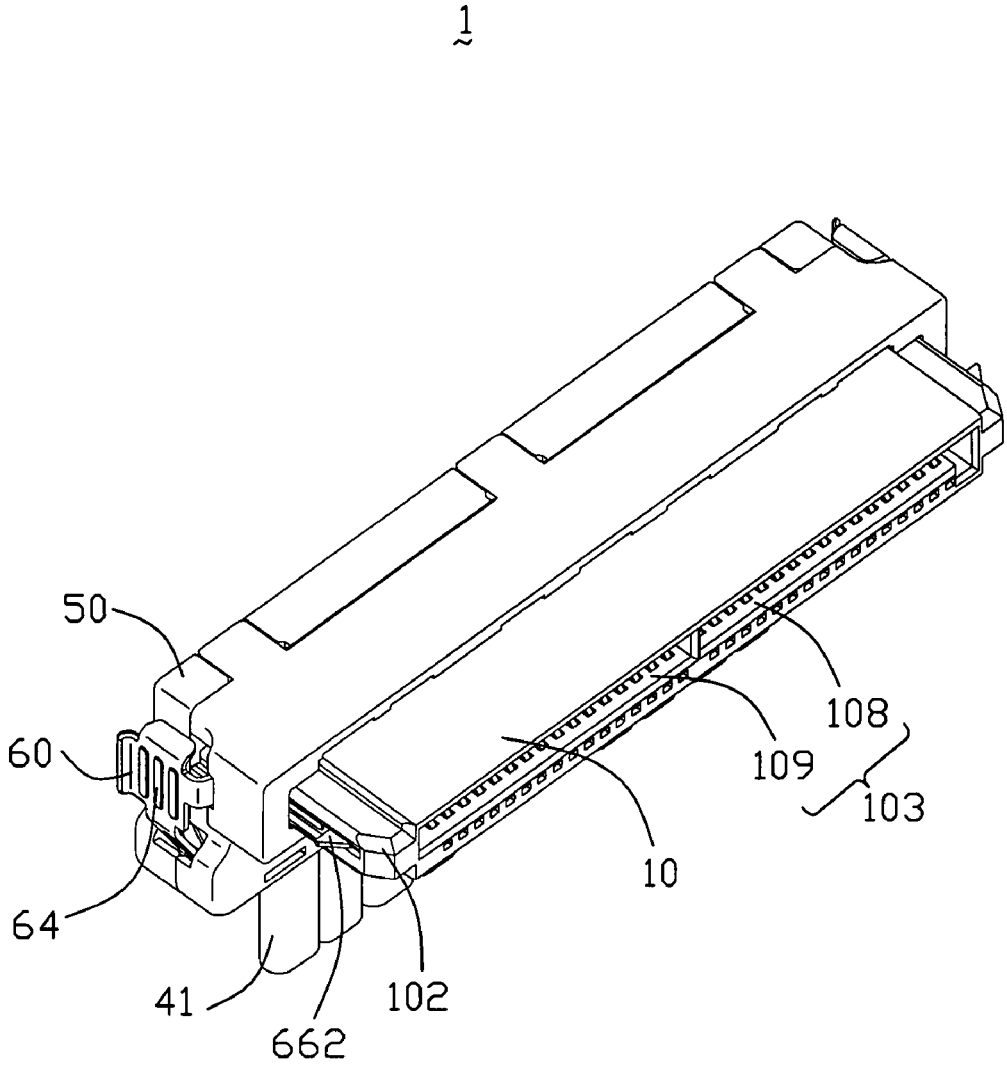
FIG. 3 is an assembled, perspective view of the cable connector assembly of FIG. 1.
Figure 4:
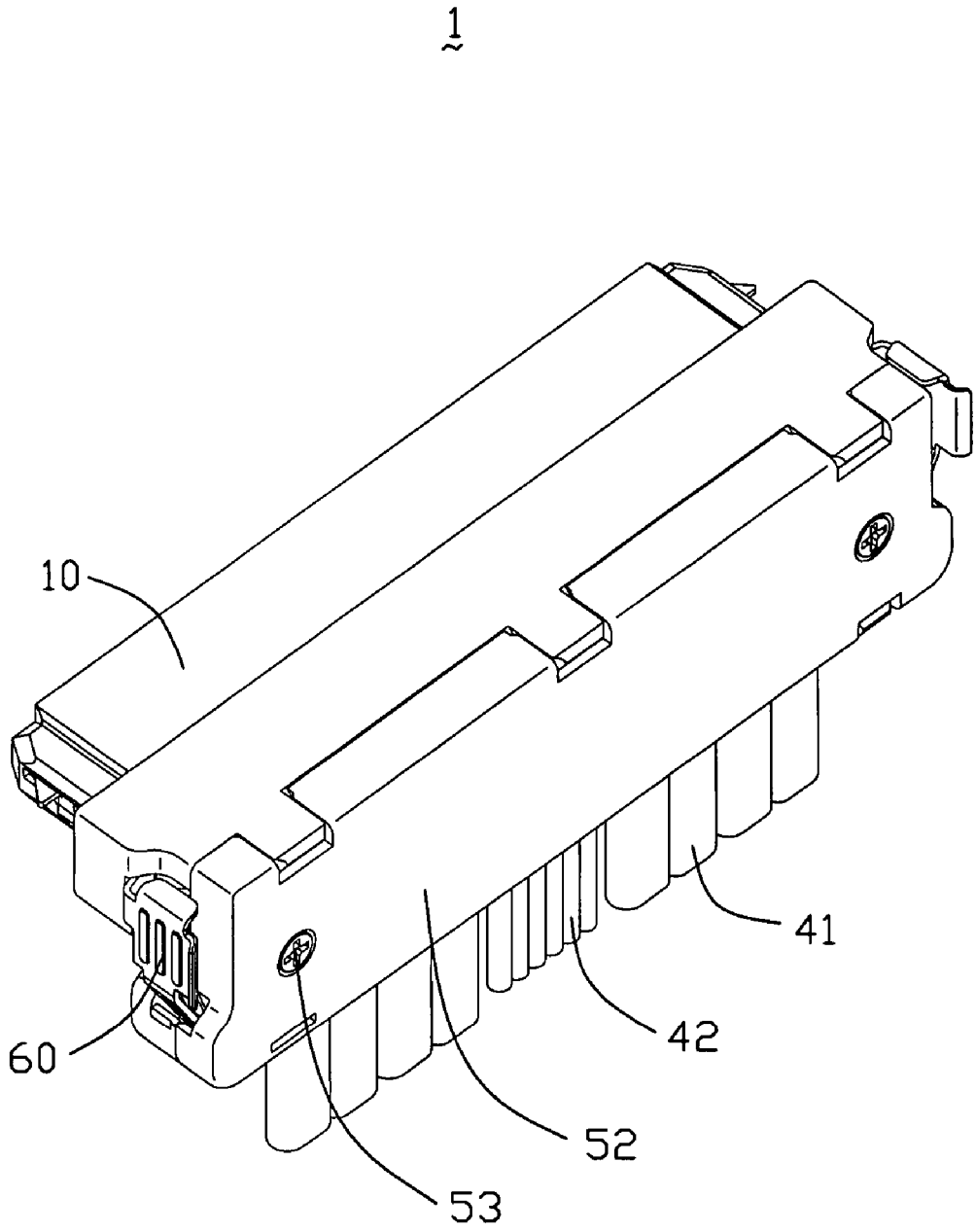
FIG. 4 is a view similar to FIG. 3, but taken from a different aspect.
Figure 5:
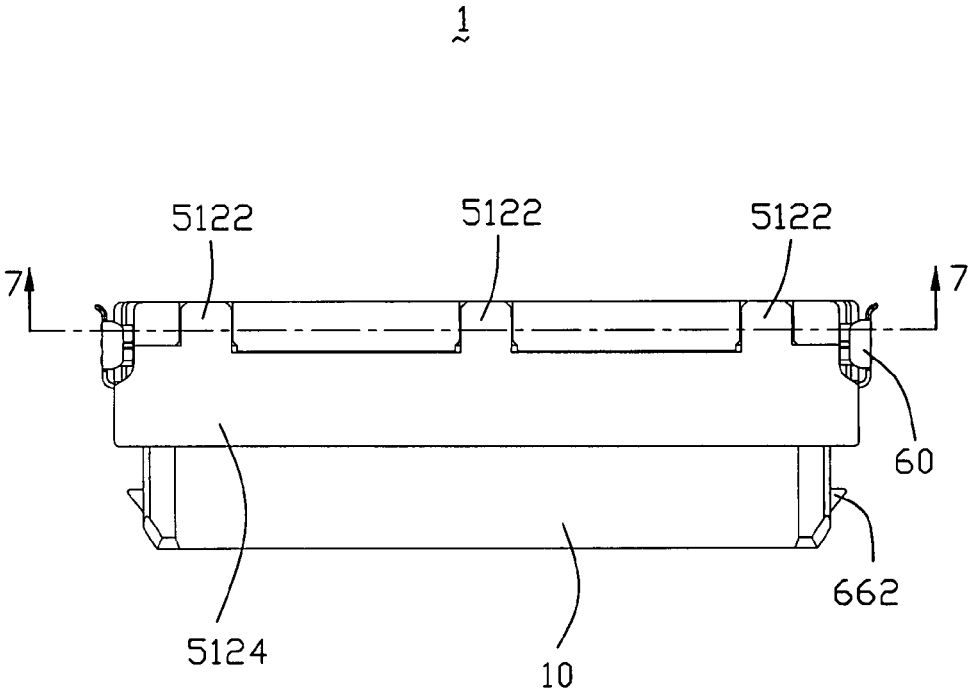
FIG. 5 is a top elevation view of the cable connector assembly.
Figure 6:
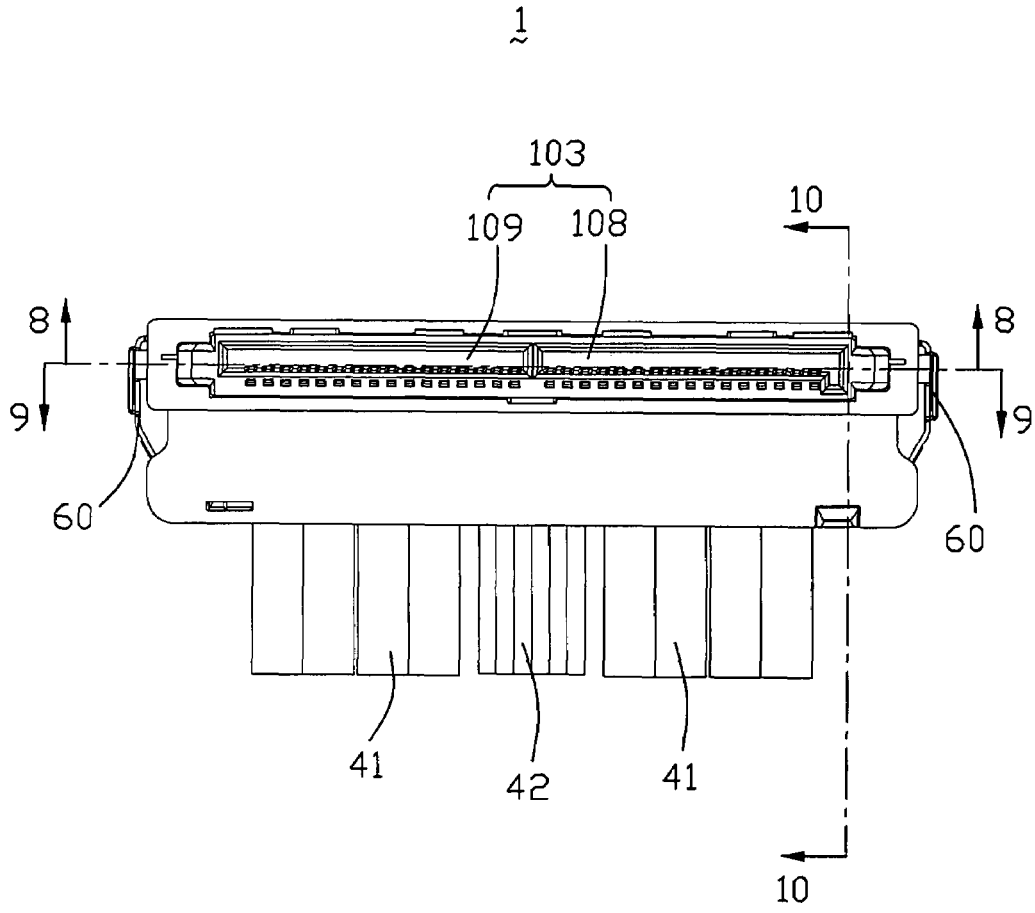
FIG. 6 is a front elevation view of the cable connector assembly.
Figure 7:
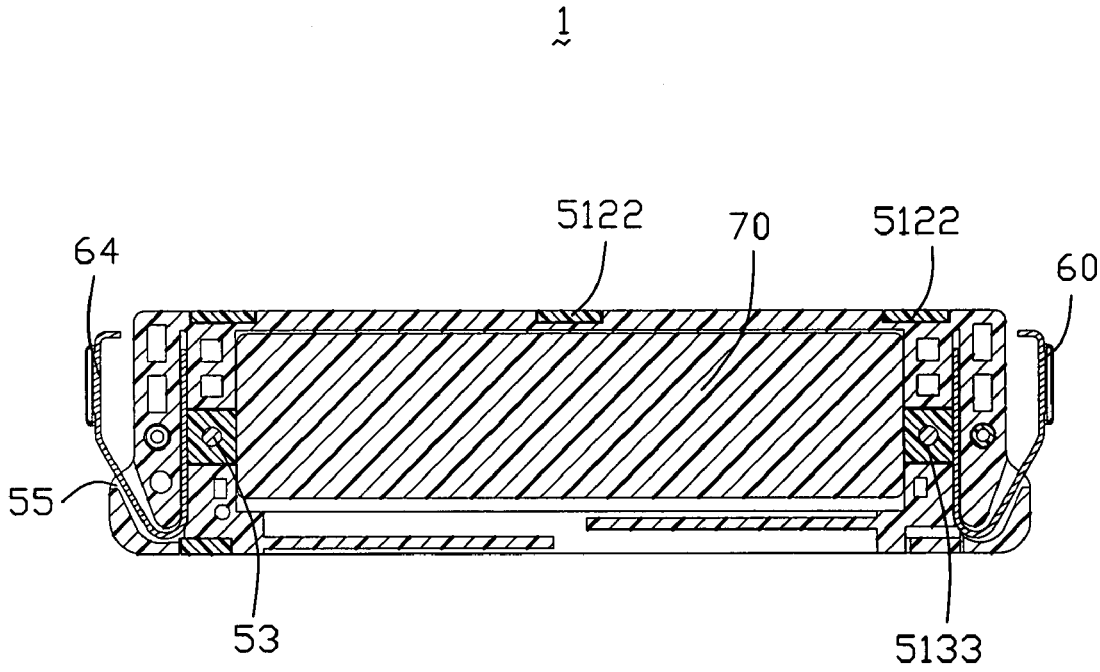
FIG. 7 is a cross-sectional view taken along line 7-7 of FIG. 5.
Figure 8:
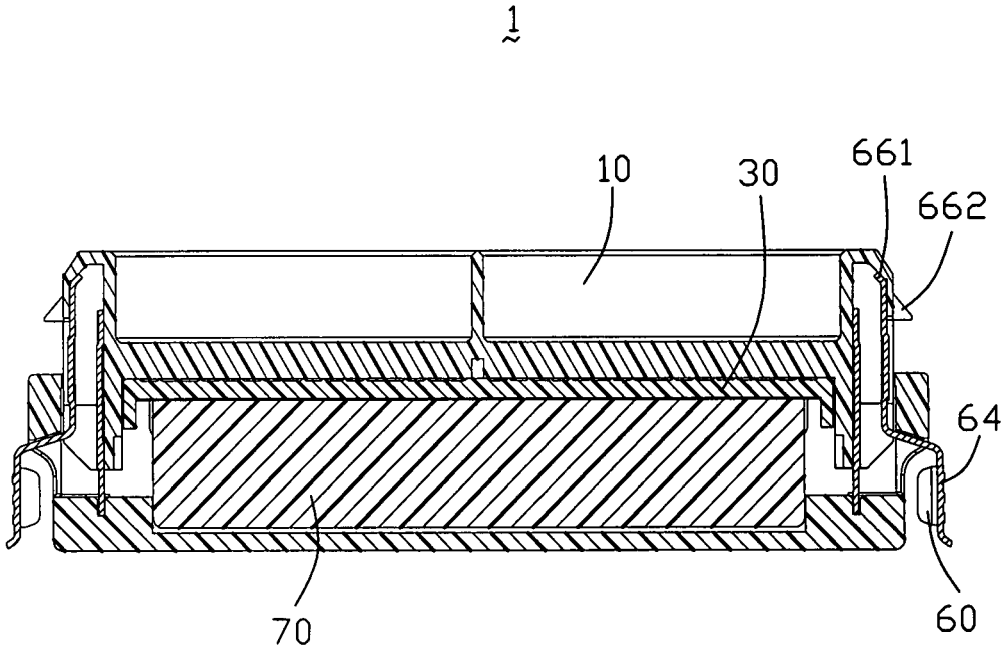
FIG. 8 is a cross-sectional view taken along line 8-8 of FIG. 6.
Figure 9:
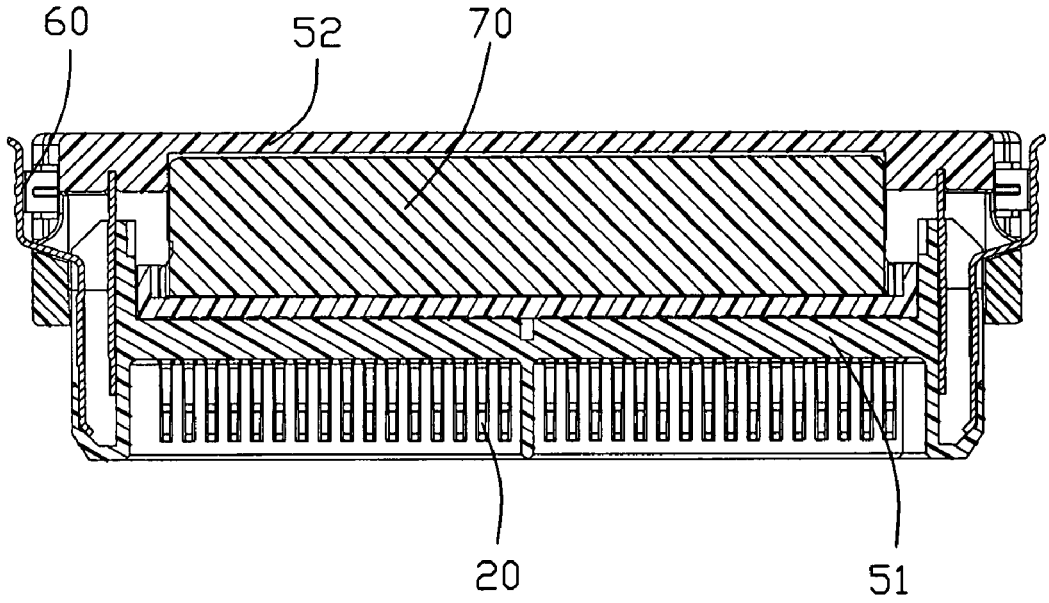
FIG. 9 is a cross-sectional view taken along line 9-9 of FIG. 6.
Figure 10:
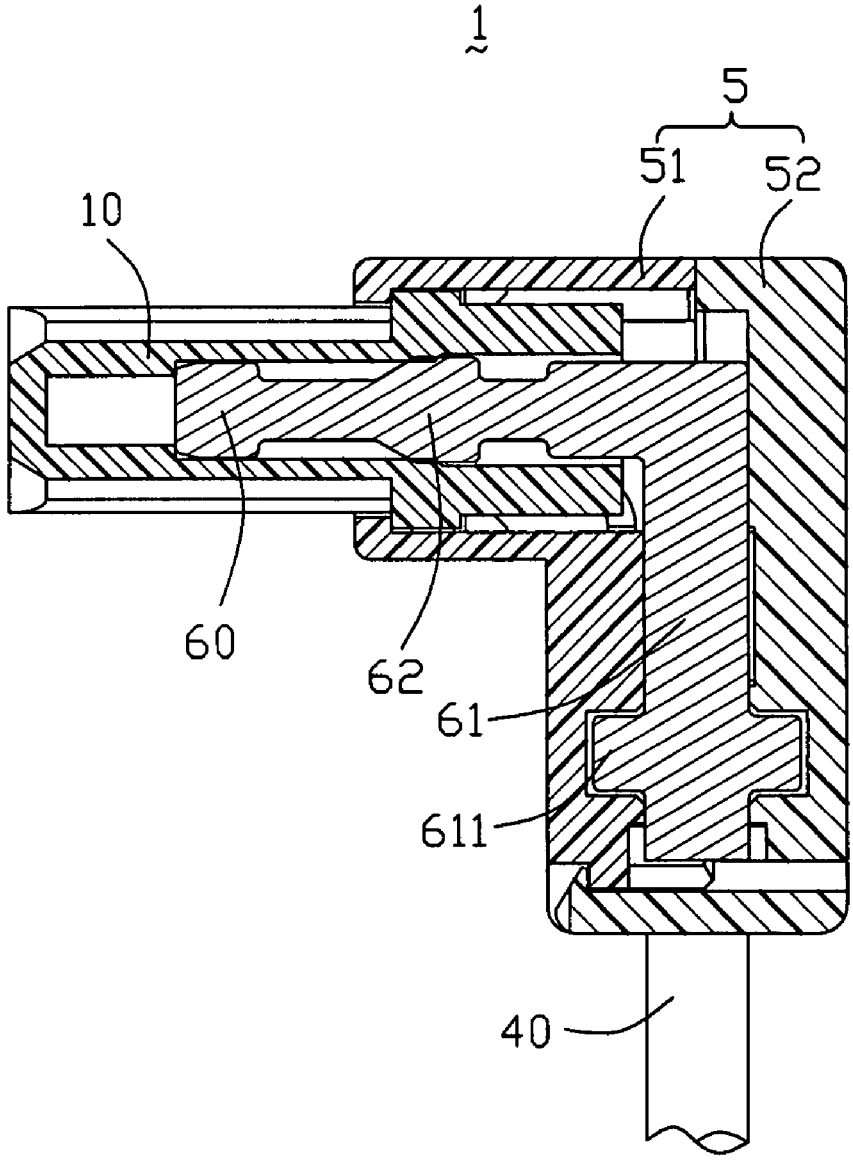
FIG. 10 is a cross-sectional view taken along line 10-10 of FIG. 6.

Particularly referring to FIGS. 1 and 2, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a front plug receiving space 103 and a rear spacer receiving space (not shown) for respectively receiving a complementary connector (not shown) and the spacer 30. A block 105 is formed with the lower wall 101 and protrudes into the plug receiving space 103. The block 105 defines a plurality of passageways 106 extending therethrough and communicating with the plug receiving space 103 and the spacer receiving space. The plug receiving space 103 is divided into an L-shaped first port 108 and a rectangular second port 109 by a vertically extended partition wall (not labeled) for receiving complementary connectors with different profiles. Each side portion 102 defines a first retention cavity 111 recess inwardly from outer side surface thereof for engaging with the locking member 60. The insulative housing 10 further defines a plurality of cutouts 104 on the upper and bottom faces adjacent to a rear face thereof.

Referring to FIGS. 1 and 2, the contacts 20 are received in the passageways 106 of the insulative housing 10 and each contact comprises a contact portion 21, a tail portion 23 and a housing retaining portion 22 connecting the contact portion 21 and the tail portion 23. The contact portions 21 extend into the L-shaped first port 108 and the rectangular second port 109 of the plug receiving space 103 of the housing 10, respectively. The housing retaining portions 23 are secured within the passageways 106 of the housing 10 by an interference fit. The spacer 30 is mounted to seal a rear end of the insulative housing 10, and comprises a plurality of through holes 31 recessed rearward from a front surface thereof for allowing the tail portions 21 of the contacts 20 extending therethrough. The spacer 30 can prevent plastic material from entering into the passageways 106 of the insulative housing 10 when molding an insulator 70. The contacts 20 and the spacer 30 can be integrally formed before mounting to the insulative housing 10, if desired.

The cables 40 comprise two pairs of first 4-lane cables 41 and a group of second flat ribbon cables 42 located between the two pairs of first cables 41. The second cables 42 are divided into two groups. The first cables 41 and the second cables 42 are respectively designed to transit high-speed signal and low-speed side-band signal. Each cable 40 comprises a plurality of conductors 43, 44 exposed outside and extending towards the spacer 30 for being soldered to corresponding tail portions 22 of the contacts 20.

The insulator 70 is over-molded to enclose the cables 40 and enclosed by the cover 50, and comprises a base portion 71 and a distal portion 72 extending downwardly from the base portion 71 to present the insulator 70 L-shape. The cable 40 extends into the insulator 70 from the distal portion 72 along an up-to-down direction perpendicular to the front-to-back direction and the conductors 43, 44 of the cables 40 extend out of the insulator 70 along the front-to-back direction.

Referring to FIGS. 1, 2, and 7-10, the cover 50 comprises a front cover 51 and a rear cover 52. The front cover 51 is of L-shape and comprises a body portion 510 substantially located in a vertical surface, a forwardly extending mating frame 511 perpendicularly extending from the body portion 510, and a pair of side portions 513 at the opposite ends of the body portion 510. The mating frame 511 defines a rectangle frame 5121, a plurality of plastic latches 5122 extending rearwardly from a top face 5124 of the rectangle frame 5121. Each plastic latch 5122 defines a hook 5123 at the distal end thereof. In the inner face of the rectangle frame 5121, a plurality of projections 516 are disposed alternatively corresponding to the cutouts 104 of the housing 10. Each side portion 513 comprises a U-shape receiving cavity 5131, a positioning post 5132 located above receiving cavity 5131 and a screw-hole 5133 located beside the positioning post 5132. At the bottom of the body portion 511, a block 5111 and a channel 5112 are defined. The rear cover 52 comprises a body portion 520 and a pair of side portions 523 at the opposite ends of the body portion 520. Each side portion 523 defines a U-shaped receiving cavity 5231, a positioning hole 5232 located above receiving cavity 5232, and a screw-hole 5233 located beside the positioning hole 5232. The body portion 520 defines a plurality of retaining channels 5211, a block 5212 corresponding to channel 5112 with a stepped forward end on the front cover, and a channel 5213 corresponding to the block 5111 on the front cover 51. Each retaining channel 5211 comprises a step portion 5210 at a rear end thereof. The retaining channel 5211 is used to receive corresponding plastic latch 5122 with the hook 5123 engaging with step portion 5210.

The front and the rear covers 51, 52 assembled together along the front-to-back direction, the U-shape receiving cavities 5131, 5231 are combined together to form a second receiving cavity 55. The positioning posts 5132 are inserted into the positioning holes 5232 for position. The screw-holes 5133, 5233 are aligned with one another to form a pair of screw-passageways (not labeled), and used to let a pair of screws 53 go through for retaining the cover 51, 52 together.

Figure 11:
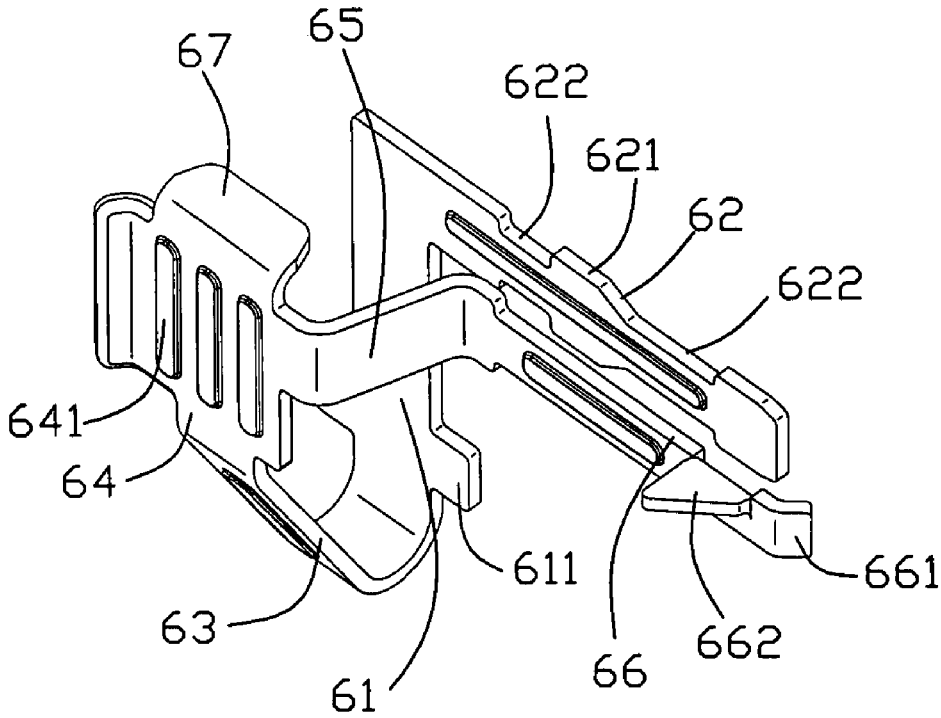
FIG. 11 is an enlarged view of a locking member shown in FIG. 1.
Figure 12:
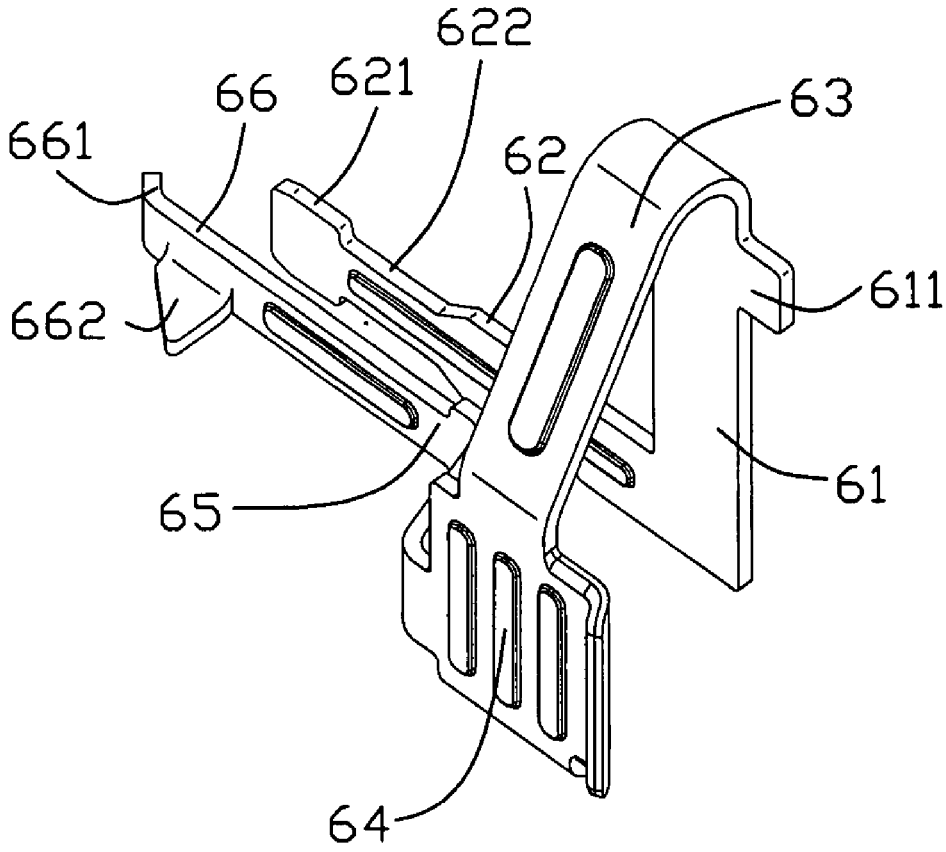
FIG. 12 is a view similar to FIG. 11, but taken from a different aspect.

Referring to FIGS. 11 and 12, each locking member 60 is stamped and formed from a metallic plate and comprises an elongate housing retention section 62 extending along the front-to-back direction, a cover retention section 61 extending downwardly from the housing retention section 62 along the up-to-down direction perpendicular to the front-to-back direction, a spring section 63 extending upwardly and slantways from the cover retention section 61, a flat pushing section 64 extending upwardly from the spring section 63 and run parallel with the housing retention section 61 along the front-to-back direction, an L-shaped positioning section 65 extending forwardly from the pushing section 64, and a latch section 66 extending forwardly from the positioning section 65. The housing retention section 62 is partially cut to form two pairs of recesses 622, thus, also forms a pair of retention tabs 621 at middle and a tip end thereof. The cover retention section 61 defines a pair of retention tabs 611 extending from opposite edges thereof for engaging with the cover 50. The pushing section 64 defines a plurality of protrusions 641 on an outer surface thereof for handling concentrically. A stopping section 67 extends towards the cover retention section 61 from upper edge of the pushing section 64. The latch section 66 comprises a protrusion 661 slantways extending toward the housing retention section 62 and a locking tab 662 bent and extending outwardly.

Referring to FIGS. 7 to 10, in assembly, the housing retention section 62 of the locking member 60 is received in the first retention cavity 111 of the housing 10 with the retention tabs 621 being engaged therein. The cover retention section 61 received in the second retention cavity 55 of the cover 50 with the retention tabs 61 extending to and securely retained in the cover 50. The pushing section 64 and the stopping section 67 are located in the depression (not labeled) of the cover 50, and the stopping section 67 extends towards the cover 50 for preventing the locking member 60 to be bent too more. The latch section 66 is received in the first retention cavity 111 of the housing 10 and the locking tab 662 projects outside the housing 10. The front cover 51 is assembled on the housing 10 along the front-to-back direction with the housing 10 passing through the mating frame 511, and the projections 516 are inserted into the cutouts 104 on the housing 10 to avoid the housing 10 moving backwardly. When the cable assembly 1 mates with the complementary connector, an inward pressing force is firstly exerted on the pushing sections 64 of the locking members 60 by user's fingers to drive the latch section 66 to move inwardly. Once the pressing force is released, the latch section 66 restore to its original position due to their own elasticity, and thus, locks with the complementary connector through the locking tab 622. The positioning tabs 651 of the positioning section 65 abut against the housing 10 for assuring a reliable mating between the cable assembly 1 and the complementary connector. When the cable assembly 1 is to be disengaged from the complementary connector, a contrary operating procedure is applied.

Figure 13:
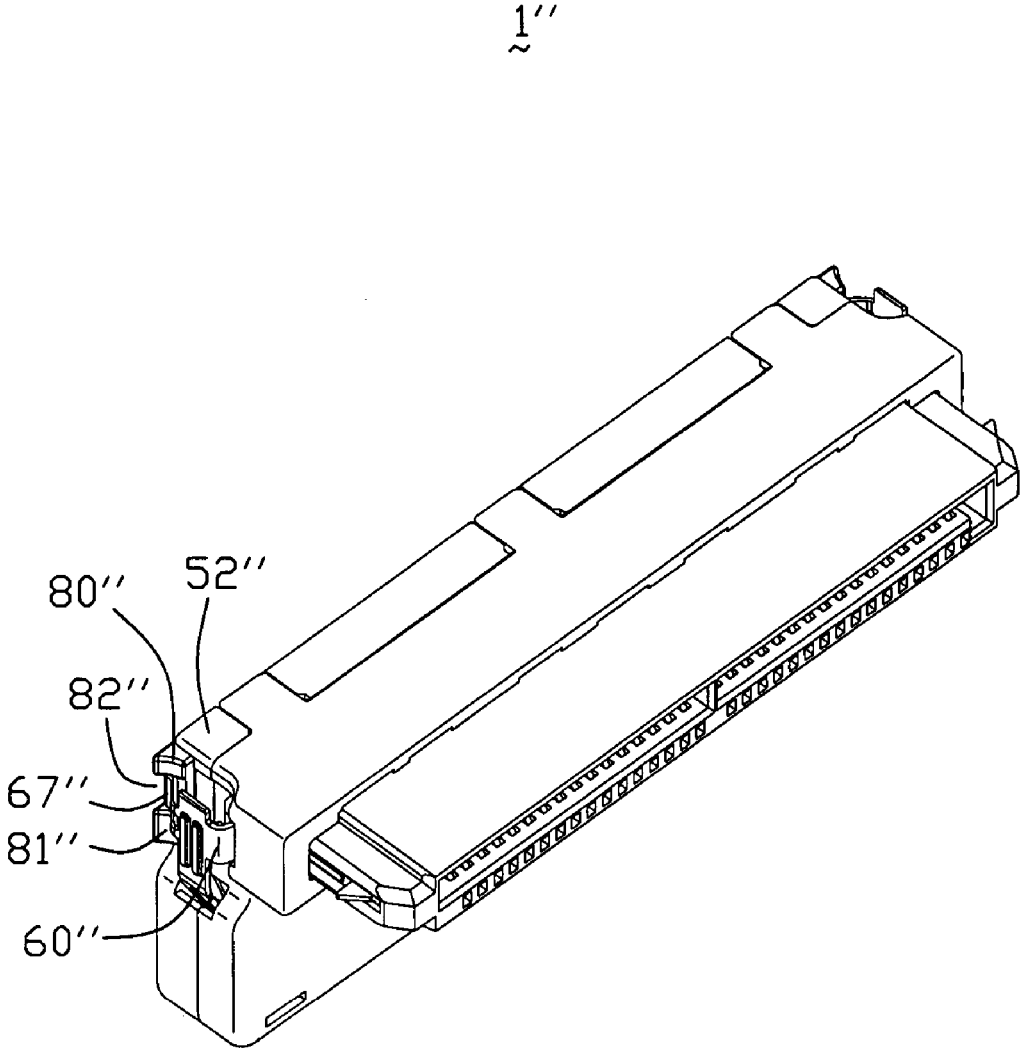
FIG. 13 is an assembled, perspective view of the cable connector assembly of a second embodiment.
Figure 14:
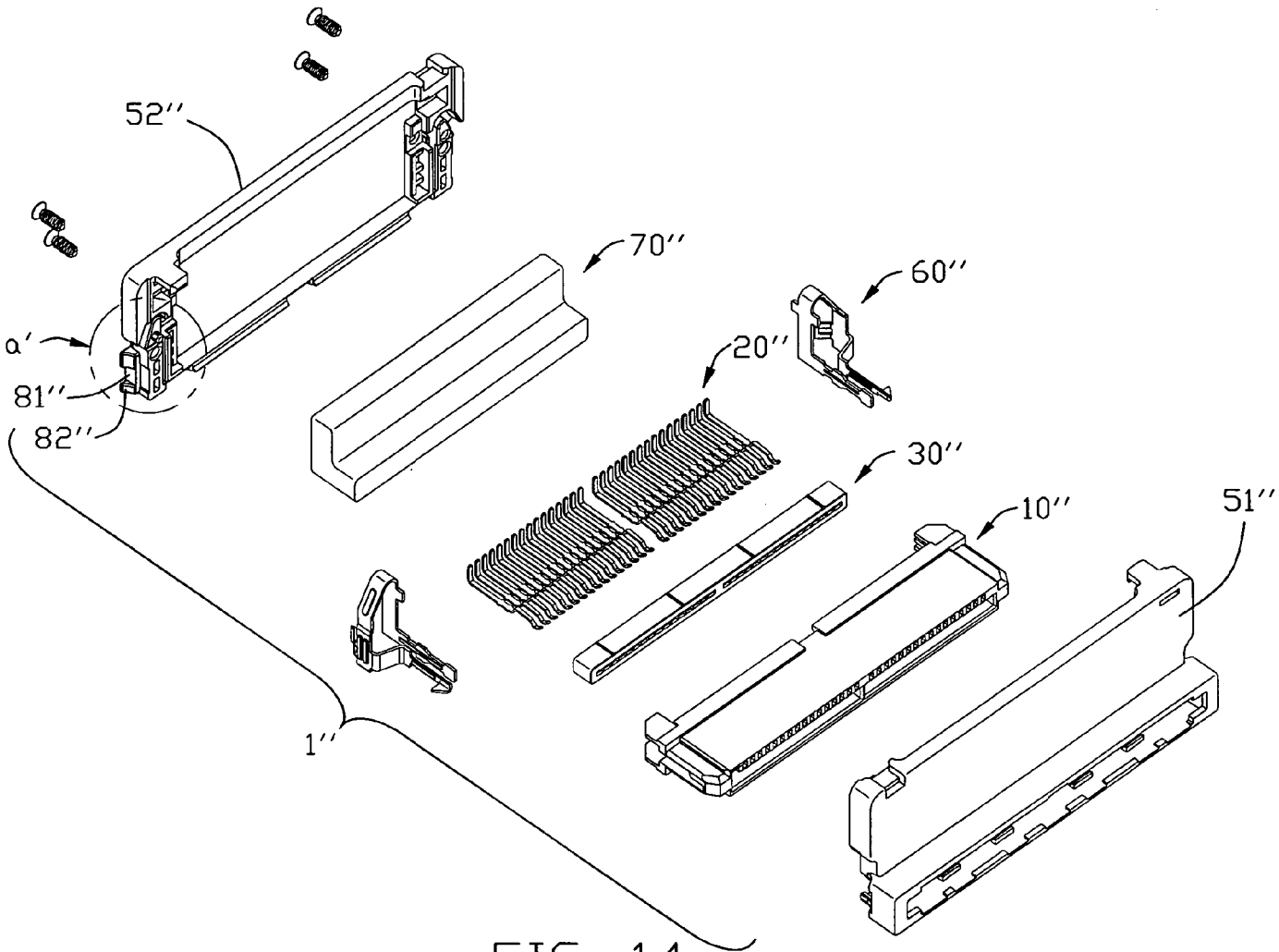
FIG. 14 is an exploded, perspective view of a cable connector assembly shown in FIG. 13.
Figure 15:
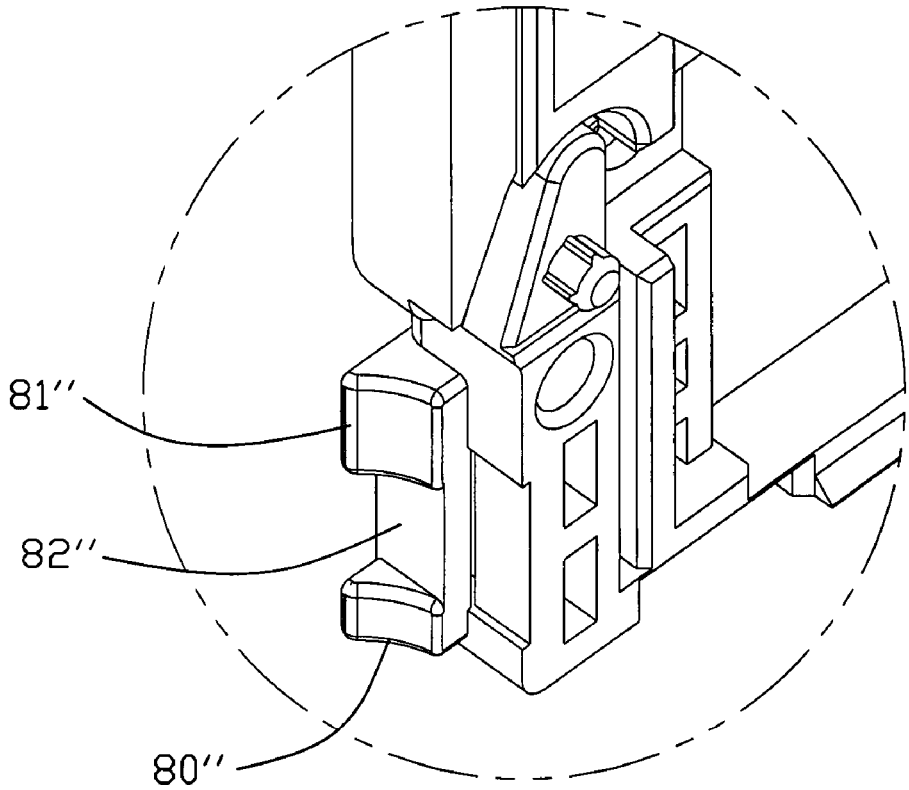
FIG. 15 is an enlarged view of a labeled in FIG. 14.
Figure 16:
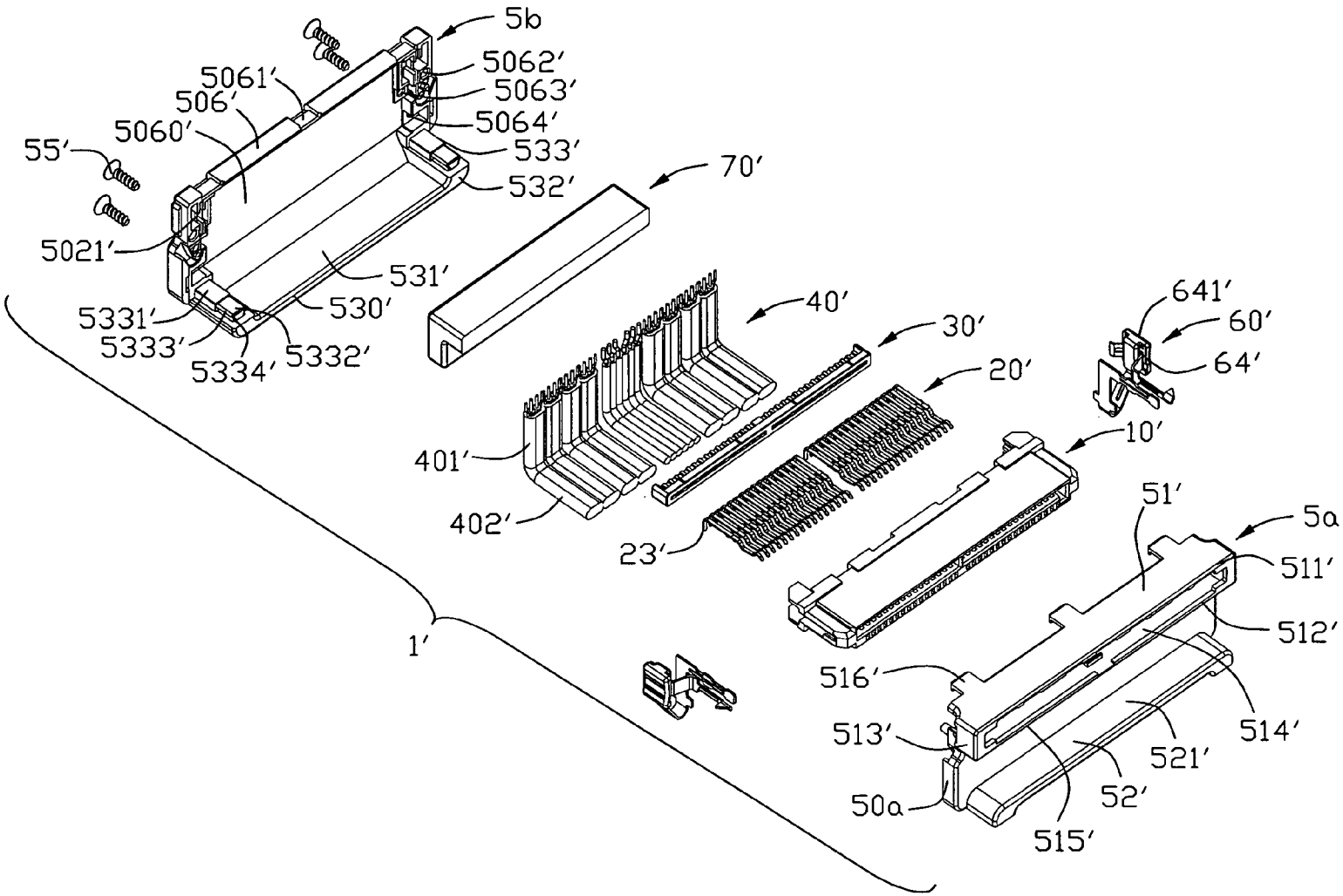
FIG. 16 is an exploded, perspective view of the cable connector assembly of a third embodiment.
Figure 17:
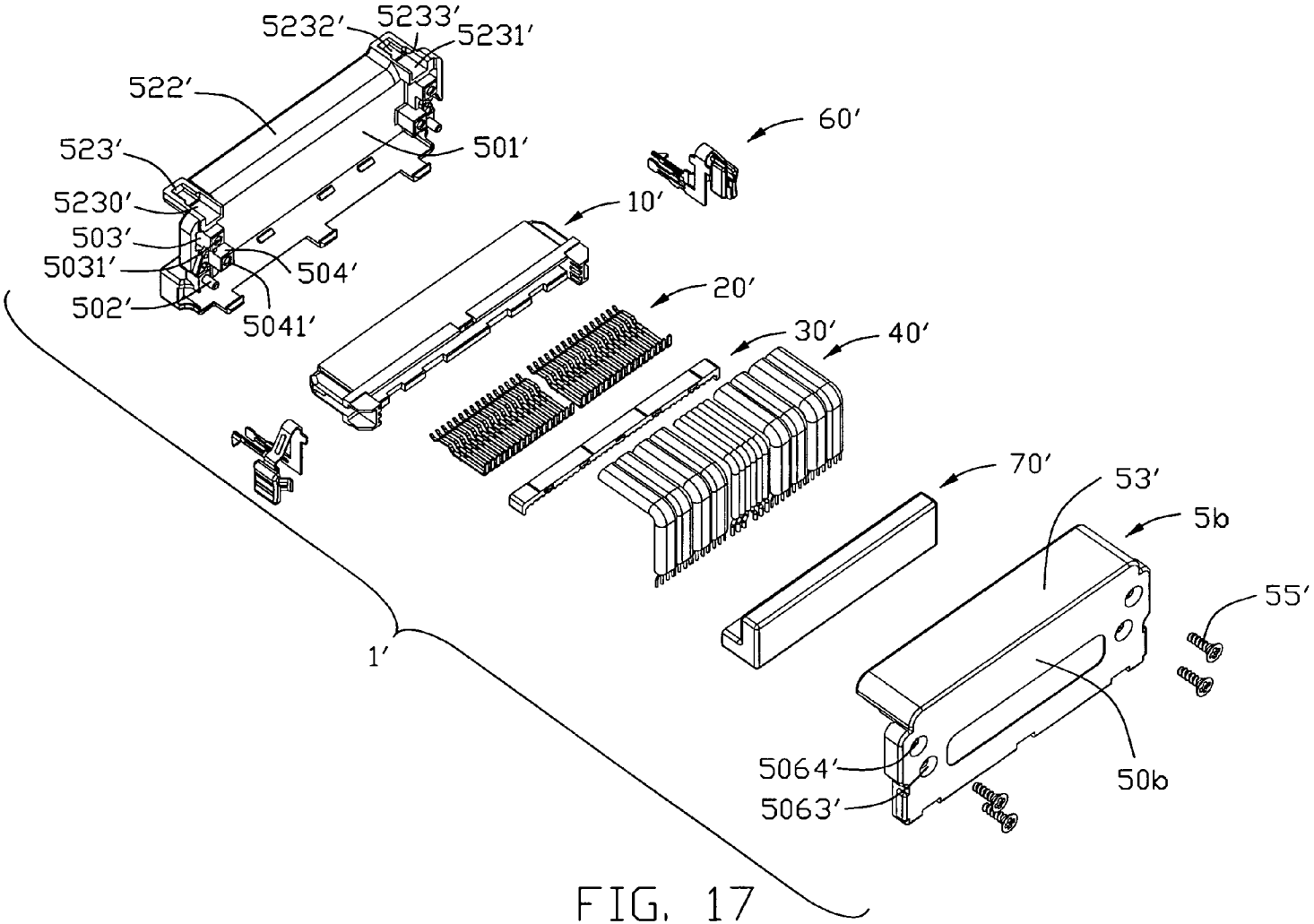
FIG. 17 is an exploded, perspective view similar to FIG. 16, but taken from a different aspect.
Figure 18:
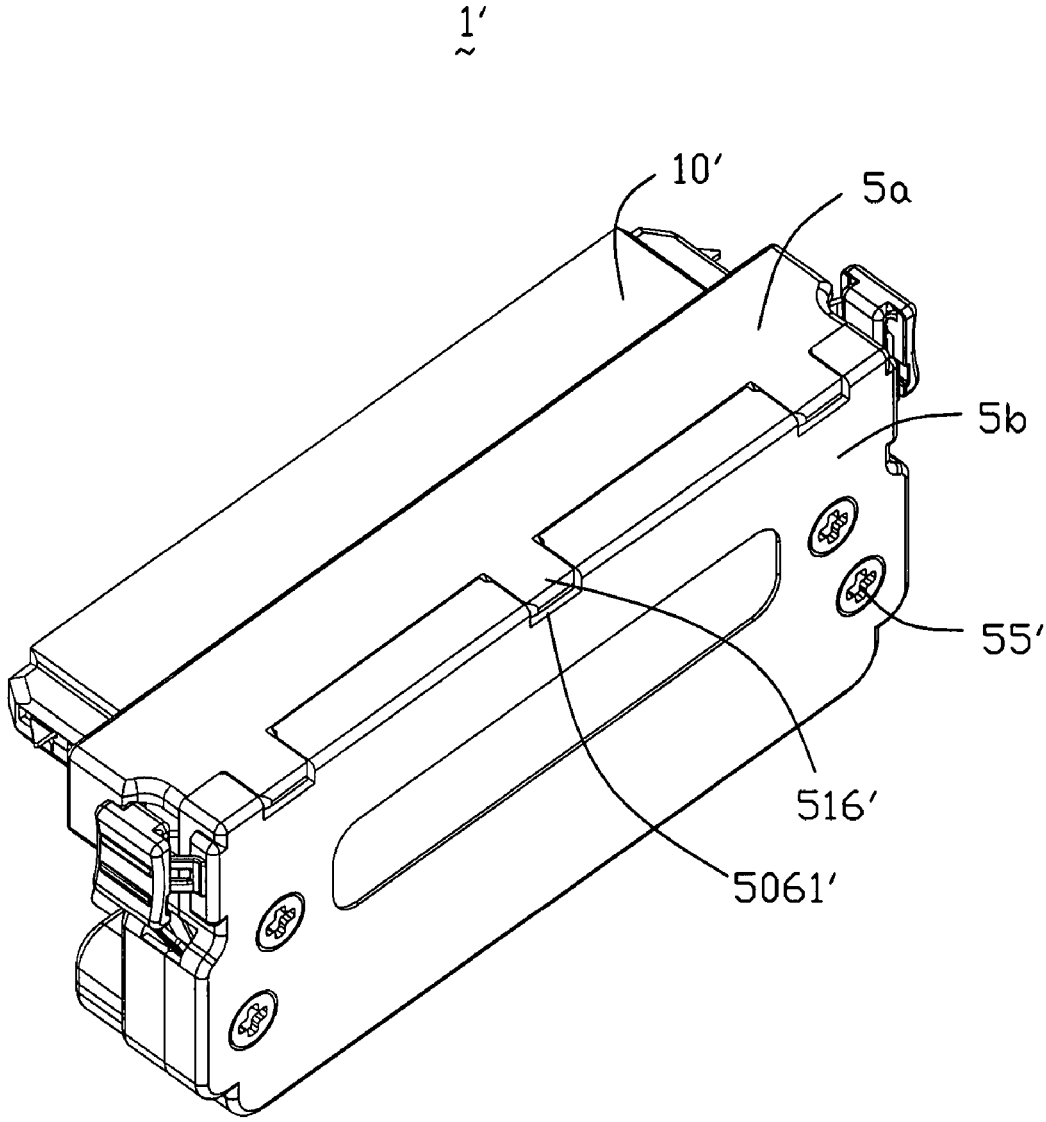
FIG. 18 is an assembled, perspective view of the cable connector assembly of FIG. 17.
Figure 19:
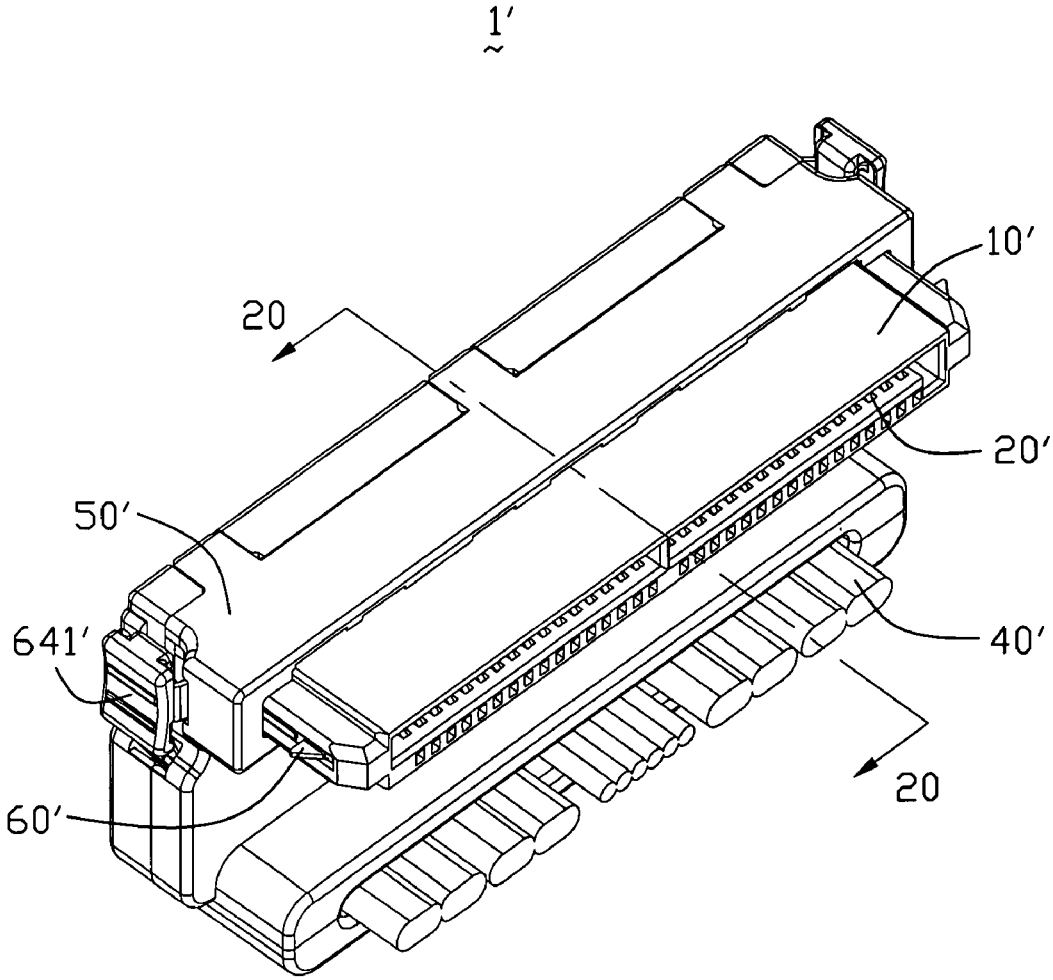
FIG. 19 is a view similar to FIG. 18, but taken from a different aspect.
Figure 20:
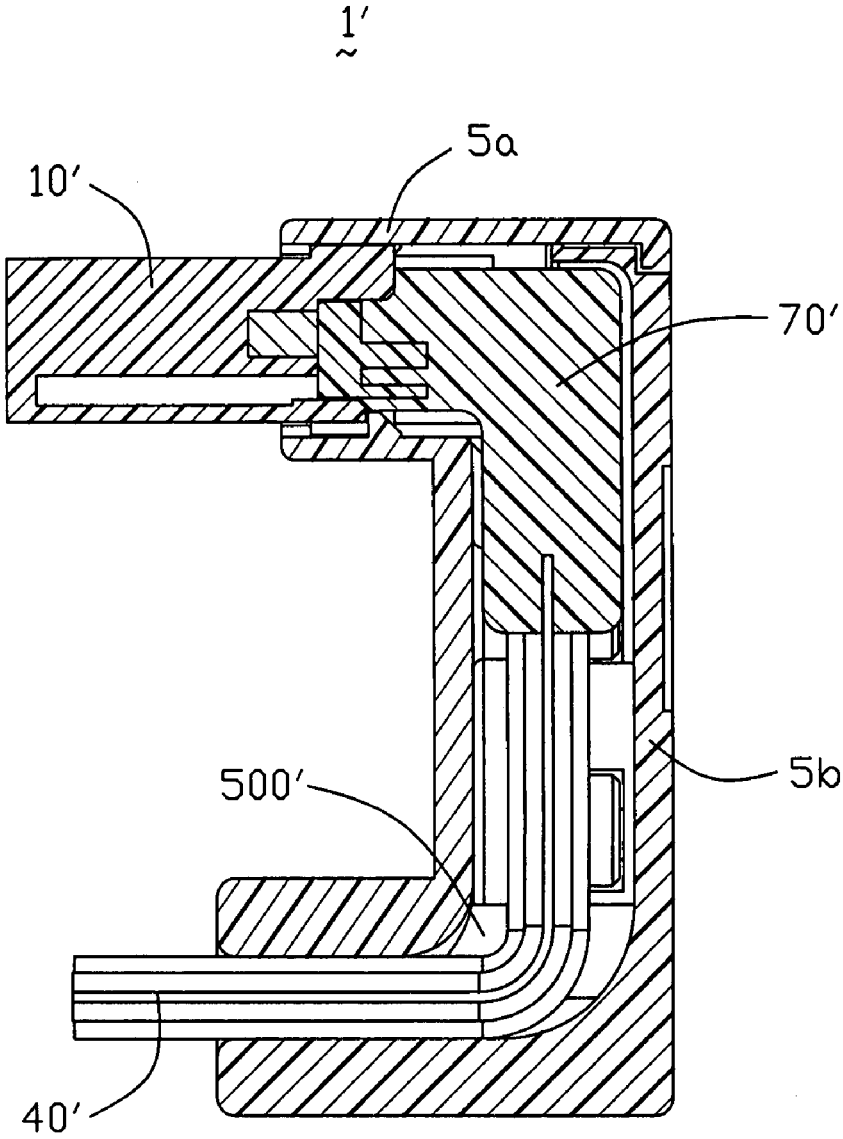
FIG. 20 is a cross-sectional view taken along line 20-20 of FIG. 19.

In a second embodiment shown in FIGS. 13-15, the cable connector assembly 1" further defines a preventing portion 80" at opposite ends of the rear cover 52" thereof. Each preventing portion 80" comprises a pair of arc-projections 81" and a slit 82" between. When a person presses the locking member 60", the finger of the person can not press further deeply because of the existance of the arc-projections 81", and the slit 82" is applied to receive the stopping section 67" of the locking member 60". Thereby, it avoids the locking member 60" broken cause of an overage pressure.

Referring to FIGS. 16-20, a cable connector assembly 1' in accordance with a third embodiment of the present invention is illustrated. The cable connector assembly 1' also comprises an insulative housing 10', a plurality of contacts 20', a spacer 30', a plurality of cables 40', a cover 50' and a pair of locking members 60' and an insulator 70'. The insulated housing 10', the contacts 20', the spacer 30', the cables 40', the locking members 60' and the insulator 70' are similar to corresponding element members illustrated in the first embodiment, excepted that tail portions 23' of the contacts 20' are bent to be of an L-shape after the spacer 30' is assembled thereon, rear portions of cables 40' are configured to such L-shaped structure that includes a vertical section 401' and a horizontal section 402', the locking member 60' further has a subsidiary handle portion 641' assembled to a pushing section 64' thereof which is convenient for user to operate the lock member 60'.

The cover 50' comprises a front cover **5*a* and a rear cover 5*b*. The front cover 5*a* is substantially U-shaped viewed laterally and comprises a first vertical body portion 50*a*, a horizontal frame portion 51' located on an upper section of the first vertical body portion 50*a* and further extending forward therefrom, a first horizontal cable holding part 52' located on a lower section of the first vertical body portion 50*a* and further extending forward therefrom either. The rear cover part 5*b* is of an L-shape viewed laterally and comprises a second vertical body portion 50*b* and a second horizontal cable holding part 53' located on a lower section of the second vertical body portion 50*b*** and extending forward therefrom.

The frame portion 51' consists of a top side 511', a bottom side 512' opposite to the top side 511' and a pair of lateral sides 513' to enclose a receiving space 514' for receiving the insulative housing 10'. The top, bottom and lateral sides 511', 512', 513' further define protruding members 515' proximate to forward ends thereof to prevent the insulated housing 10' slide out of the receiving space 514'. Three locking arms 516' symmetrically arranged at a back edge of the top wall 511' and extending rearward therefrom. The first vertical body portion **50*a* includes a first board portion 501' and some securing members located at lateral sections thereof. The securing members comprise a pair of cylindrical-shaped retention posts 502' respectively located at higher section of the lateral sections of first board portion 501', two pairs of rectangular-shaped posts 503', 504' offset from one another and arranged below the pair of cylindrical-shaped retention posts 502', respectively. Each of the rectangular-shaped posts 503', 504' further defines a screw hole 5031', 5041' therein. The first horizontal cable holding part 52' comprises a first body portion 521' defining a substantially rectangular-shaped depression portion 522' recessed upward from bottom surface thereof and a pair of side walls 523' arranged at lateral sides of the depression portion 522'. Each side wall 523' has a retaining groove 5230' recessed upward from bottom surface thereof and disposed along longitudinal direction. The retaining groove 5230' consists of a rear groove portion 5231' with a back opening (not numbered) and a narrower front groove portion 5232' located forward and communicated with the rear groove portion 5231'. The front groove portion 5232' further has two keying ways 5233'** arranged two opposite sides thereof.

The second vertical body portion **50*b* includes a second board portion 506' and some complementary securing members for coupling with the securing members of the lateral sections of the first board portion 501' and located at lateral sections of the second board portion 506'. The second board portion 506' defines a roomage 5060' for receiving the vertical sections 401' of the cables 40'. Three retaining slots 5061' are symmetrically defined in a top surface of the second board portion 506' for locking with the locking arms 516' of the front cover 5*a*. The complementary securing members comprise a pair of retention holes 5062' respectively located at top section of the second board portion 506', two couples of through screw holes 5063', 5064' offset from one another and arranged below the pair of retention holes 5062', respectively. The pair of retention holes 5062' are used for receiving the pair of cylindrical-shaped retention posts 502'. While the two couples of through screw holes 5063', 5064' align with the two couples screw holes 5031', 5041' to allow screws 55' inserting therein to combine the front cover 5*a* and the rear cover 5*b* together. A pair of second retention cavities 5021' respectively defined between the pair of retention holes 5062' and the two couples of through holes 5063', 5064'. The second horizontal cable holding part 53' comprises a body portion 530' defining a substantially rectangular-shaped depression portion 531' and a pair of side walls 532' arranged at two sides of the depression portion 531'. Each side wall 532' forms a retaining beam 533' located on a top surface thereof and extending forward from a corner portion between the side wall 532' and the second board portion 506'. The retaining beam 533' consists of a rectangular-shaped rear beam portion 5331' and a narrower rectangular-shaped front beam portion 5332' extending forward from front end of the rear beam portion 5331'. The front beam portion 5332' further defines a pair notches 5334' at lower sections of two lateral sides thereof, therefore, corresponding ribs 5333' are formed at upper sections of the front beam portion 5332'. The rear beam portions 5331' are adapted to be received in the rear groove portions 5231' of the front cover 5*a*, while the front beam portions 5332' can be housed in the front groove portions 5232' of the front cover 5*a*. Therefore, the ribs 5333' are insert into two keying ways 5233' to prevent the front cover part 5*a* moving upward when it is assembled to the rear cover part 5*b***.

Referring to FIGS. 16-20 and in conjunction with FIGS. 1-12, in assembly, the locking member 60' is assembled to the insulative housing 10' and the cover 50' in a manner same as a manner/method that the locking member 60 assembled to the insulated housing 10 and the cover 50, with the subsidiary handle portion 641' exposed outward of the cover 50'. The front cover 5*a* is assembled to the rear cover 5*b* along the front-to-back direction, with the retaining beams 533' inserted into and engaging with the retaining grooves 523'. Thus, L-shaped cable orientation passage 500' is formed between the second vertical body portion 50*b*, the first horizontal cable holding part 52' of the front cover part 5*a* and a second vertical body portion 50*b*, a second horizontal cable holding part 53' of the rear cover part 5*b*. Rear sections of cables 40' are retained in the cable orientation passage 500', with the vertical sections of the cables 401' are received in the roomage 5060', partial of end sections of the horizontal sections 402' of the cables 40' received in the depression portions 522', 531'. Thus, an outlet orientation of the cables 5 is the same as the mating direction of the cable assembly 1' with the complementary connector.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly mating with a complementary connector along a front-to-back direction, comprising:

an insulative housing defining a forwardly extending mating port with a pair of opposite side portions, with at least one first retention cavity defined therein;

a plurality of contacts disposed in the housing;

a cover being at least partially configured to be of an L-shape, said cover including a front and a rear covers assembled to the housing along the front-to-back direction and defining a pair of opposite side sections, with at least one downwardly extending second retention cavity defined therein;

wherein the first retention cavity aligned with the corresponding second retention cavity in an up-to-down direction perpendicular to the front-to-back direction;

at least one locking member being configured to be of an L-shape and arranged aside corresponding L-shaped section of the cover, said locking member comprising a cover retention section received in the second retention cavity of the cover, and a housing retention section extending into the first retention cavity of the housing; and at least one cable connected to a rear portion of the housing and being partially enclosed by the cover.

2. The cable connector assembly as described in claim 1, wherein the cover is of an L-shape and the cable extends out of the cover along a direction perpendicular to that the cable assembly mates with the complementary connector.

3. The cable connector assembly as described in claim 1, wherein the cover is of U-shaped and the cable extends out of the cover along a direction same as that the cable assembly mates with the complementary connector.

4. The cable connector assembly as described in claim 1, wherein the front cover is substantially U-shaped viewed from lateral side and the rear cover is of an L-shape, and wherein the front cover and the rear cover are combined together via securing means.

5. The cable connector assembly as described in claim 4, wherein the front cover comprises a first vertical body portion, a forward extending horizontal frame portion located on an upper section of the first vertical body portion and supporting the insulated housing, a first horizontal cable holding part located on a lower section of the first vertical body portion and further extending forward therefrom.

6. The cable connector assembly as described in claim 5, wherein the first horizontal cable holding part comprises a first body portion defining a substantially rectangular-shaped depression accommodating partial of a horizontal section of the cable.

7. The cable assembly as described in claim 4, wherein the rear cover comprises a second vertical body portion defining a roomage housing a vertical section of the cable.

8. The cable assembly as described in claim 1, wherein the front cover and the rear cover, respectively, comprises a positioning hole and a positioning post received in the positioning hole for position the front and the rear covers.

9. The cable assembly as described in claim 1, wherein the front and the rear covers, each comprises a screw hole aligns with one another to allow a screw go through.

10. The cable assembly as described in claim 1, wherein the locking member further comprises a spring section extending upwardly and slantways from the cover retention section, a flat pushing section extending forwardly from the spring section and run parallel with the housing retention section along the front-to-back direction, a positioning section extending forwardly from the pushing section.

11. The cable assembly as described in claim 10, wherein the locking member further comprises a subsidiary handle portion assembled to a pushing section and located two opposite sides of the cover.

* * * * *